US009044370B2

(12) United States Patent
Matsubara et al.

(10) Patent No.: US 9,044,370 B2
(45) Date of Patent: Jun. 2, 2015

(54) INCUBATOR

(75) Inventors: Kazuo Matsubara, Bunkyo-ku (JP); Terumi Matsubara, Nerima-ku (JP); Eiji Koike, Saitama (JP); Naoki Honma, Saitama (JP); Yoko Nagai, Nagareyama (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 749 days.

(21) Appl. No.: 13/277,501

(22) Filed: Oct. 20, 2011

(65) Prior Publication Data

US 2012/0238798 A1 Sep. 20, 2012

(30) Foreign Application Priority Data

Oct. 21, 2010 (JP) ..... 2010-236516

(51) Int. Cl.

*A61G 11/00* (2006.01)
*E05C 3/30* (2006.01)
*E05C 3/16* (2006.01)

(52) U.S. Cl.

CPC ..... *A61G 11/00* (2013.01); *A61G 11/009* (2013.01); *E05C 3/162* (2013.01); *E05C 3/30* (2013.01); *A61G 11/003* (2013.01); *A61G 11/002* (2013.01)

(58) Field of Classification Search

CPC ..... A61G 10/00–11/009; B25J 21/00–21/02; E05B 3/00–3/10; E05B 57/00; E05B 59/00; E05B 61/00; E05B 63/0052; E05C 1/08–1/166

USPC ..... 600/21–22

See application file for complete search history.

(56) References Cited

U.S. PATENT DOCUMENTS

| | | | | |
|---|---|---|---|---|
| 5,112,293 | A * | 5/1992 | Vaccaro | 600/22 |
| 5,129,879 | A * | 7/1992 | Mattson | 600/22 |
| 2005/0020872 | A1 | 1/2005 | Hampe | |
| 2010/0109347 | A1 * | 5/2010 | Matsubara et al. | 292/121 |

FOREIGN PATENT DOCUMENTS

| | | |
|---|---|---|
| EP | 0368207 | 5/1990 |
| EP | 2 172 176 | 4/2010 |
| JP | 2001-070373 | 3/2001 |
| WO | WO 99/12511 | 3/1999 |

* cited by examiner

*Primary Examiner* — Catherine B Kuhlman
(74) *Attorney, Agent, or Firm* — Hunton & Williams LLP

(57) ABSTRACT

A hand insertion door board is attached to the peripheral portion of each hand insertion window formed in an outside portion of a newborn infant container of an incubator. A holding portion is formed on one side portion of the hand insertion door board in the lateral direction. A bracket which pivotally supports a support shaft having a vertical axis is attached to the holding portion. A latch lever is pivotally supported by the support shaft of the bracket. A press lever which releases latching operation of the latch lever is pivotally attached by using the support shaft of the bracket. When the press lever is pressed against the biasing force of a compression coil spring, the press lever presses projecting pieces of the latch lever to make the latch lever pivot about the support shaft to the release position.

3 Claims, 11 Drawing Sheets

INCUBATOR

TECHNICAL FIELD

The present invention relates to an incubator including hand insertion windows provided in side surfaces of a newborn infant container, hand insertion doors which pivot to open and close the hand insertion windows, and latch mechanisms which hold the hand insertion doors at closed positions.

BACKGROUND OF THE INVENTION

An incubator includes a newborn infant container which provides a proper physiological environment for a newborn infant who cannot regulate his/her body temperature by himself/herself. Substantially the entire areas of the side surfaces and top surface of the newborn infant container are formed from a transparent material to allow to visually recognize a newborn infant in the newborn infant container from outside. This incubator is configured to control humidity and oxygen concentration as well as temperature in this newborn infant container. In some cases, a doctor, a nurse or the like needs to provide some treatment for a newborn infant in the newborn infant container. In order to provide relatively easy treatments, the newborn infant container is provided with hand insertion windows in several side surfaces of the newborn infant container, hand insertion doors which pivot to open and close the hand insertion windows, and latch mechanisms of holding the hand insertion doors at the closed positions.

In general, to maintain a proper physiological environment for a newborn infant in the newborn infant container, the hand insertion windows are closed by the hand insertion doors and are held at the closed positions by the latch mechanisms. When providing treatment for a newborn infant, however, it is necessary to open the hand insertion windows by making the hand insertion doors pivot from the closed positions to the open positions. In some cases, a person who provides treatments holds a medical instrument, medicine and the like with his/her both hands, and needs to prevent the both sterile hands from being contaminated. Under the circumstances, a conventional incubator (for example, EP 038207A2 and Japanese Patent Laid-Open No. 2-19855 to be referred to as patent literatures 1 and 2) includes unlatching members for unlatching latching mechanisms, which allow to easily open the hand insertion windows by only pressing the members with body parts such as the elbows other than the hands in a direction perpendicular to the side surface of the newborn infant container.

According to the above conventional incubator, however, although the hand insertion doors are nearly in contact with the latch mechanisms, the doors are not held at the closed position. For this reason, the hand insertion windows may be imperfectly closed. If the hand insertion windows are opened or imperfectly closed while a newborn infant is accommodated, the newborn infant container loses the proper physiological environment for the newborn infant. This may affect the physical condition of the newborn infant.

In addition, the above conventional incubator allows the hand insertion doors which are not held at the closed position by the latch mechanisms to freely pivot, and causes the latch mechanisms to abruptly move due to a biasing force when holding the hand insertion doors at the closed positions. This may cause the hand insertion doors and the latch mechanisms to collide with other portions of the incubator. The sound and vibration generated by the impact of this collision may stress the newborn infant in the newborn infant container. This may also affect the physical condition of the newborn infant.

A pair of hand insertion windows is provided in each of the left and right side surfaces of the newborn infant container of the incubator so as to be symmetric, in the lateral direction, about the middle position between the hand insertion windows. Hand insertion doors provided for these hand insertion windows are supported to be respectively pivotal about the front end side and rear end side of each side surface. Each pair of hand insertion doors juxtaposed laterally is configured to open like hinged double doors. This allows to access the newborn infant inside the container through the hand insertion windows without hindrance by the hand insertion doors. In this case, latch mechanisms are respectively provided at the right end of the hand insertion door attached to the left side of each side surface of the newborn infant container and the left end of the hand insertion door attached to the right side of the side surface. The latch mechanisms are attached to each surface so as to be symmetrical about the middle position in the lateral direction. The latch mechanisms therefore have structures symmetrical with each other in the lateral direction and substantially the same function. However, they need to be prepared as different components. This inevitably increases the number of types of components of the latch mechanisms of the left and right doors, and hence increases the cost.

SUMMARY OF THE INVENTION

It is an object of the present invention to provide an incubator which does not easily affect the physical condition of a newborn infant in spite of being capable of easily opening hand insertion windows by manipulation with body parts such as the elbows other than the hands.

It is another object of the present invention to provide an incubator which does not allow to easily generate an impact even when the latch lever of the latch mechanism pivots between the hold position and pivot position of each hand insertion window.

An incubator according to the first aspect of the present invention has a hand insertion window provided on a side surface of a newborn infant container, a hand insertion door configured to pivot to open and close the hand insertion window, and a latch mechanism configured to hold the hand insertion door at a closed position for the closing;

the latch mechanism comprising a latch lever configured to pivot between a hold position for the holding and a release position for releasing the holding on the side surface of the newborn infant container, and a press lever configured to pivot about an axis identical or parallel to a pivot axis of the latch lever to make the latch lever pivot to the release position.

The incubator according to the main aspect of the present invention can be configured such that a hand insertion door board is attached along a peripheral portion of the hand insertion window, a pivot support mechanism is provided on one side portion of the hand insertion door board in a lateral direction, the hand insertion door is supported so as to be pivotal about a vertical axis of the pivot support mechanism, the latch mechanism is provided on the other side portion of the hand insertion door board, and the latch mechanism holds the hand insertion door at a closed position by pressing a tongue-like portion on a distal end side of the hand insertion door. In addition, a holding portion is preferably provided on the other side portion of the hand insertion door board, and the latch mechanism is preferably attached by being held by the holding portion.

In addition, the incubator can be configured such that a bracket is attached and fixed on a holding portion of the hand insertion door board, the latch lever is pivotally supported by a vertical support shaft supported by the bracket, and the latch lever is pivotally biased by a biasing spring to cause a distal end side projection to press the tongue-like portion on the distal end side of the hand insertion door so as to hold the hand insertion door at the closed position. The press lever can be pivotally supported by the support shaft on the bracket, and when the press lever is pressed, the press lever can press a projecting piece of the latch lever to make the latch lever pivot to the release position.

The incubator according to another aspect of the present invention further comprises an opening mechanism configured to bias the hand insertion door in the opening direction by abutting against the hand insertion door during the pivoting of the hand insertion door in the closing direction before completion of the closing operation. In this case, the incubator comprises a braking mechanism configured to brake the pivoting of the hand insertion door on the way in the opening operation during the pivoting of the hand insertion door in the opening direction.

According to the incubator of the first aspect of the present invention, when the operator makes the press lever pivot about an axis identical or parallel to the pivot axis of the latch lever to make the latch lever pivot to the release position, the latch mechanism including the latch lever releases the hand insertion door. This makes it possible to easily open the hand insertion doors by manipulation with body parts such as the elbows other than the hands. In addition, an impact is not easily generated accompanying the manipulation of the latch mechanism, and a large stress is not imposed on the newborn infant in the newborn infant container at the time of operation of the latch mechanism. Therefore, this operation does not easily affect the physical condition of the newborn infant.

In the incubator, the hand insertion door board is attached along the peripheral portion of the hand insertion window, the pivot support mechanism is provided on one side portion of the hand insertion door board in the lateral direction, the hand insertion door is supported so as to be pivotal about the vertical axis of the pivot support mechanism, the latch mechanism is provided on the other side portion of the hand insertion door board, and the latch mechanism holds the hand insertion door at the closed position by pressing a tongue-like portion on the distal end side of the hand insertion door. In this incubator, each hand insertion door is pivotally supported by the pivot support mechanism provided on one side portion on the hand insertion door board, and the latch mechanism on the other side portion of the hand insertion door board holds the hand insertion door at the closed position while the hand insertion door closes the hand insertion window. In addition, the pivot mechanism and latch mechanism of the hand insertion door are assembled on the hand insertion door board.

According to the incubator in which the holding portion is provided on the other side portion of the hand insertion door board, and the latch mechanism is attached by being held by the holding portion, since the latch mechanism is held on the holding portion of the other side portion, the latch mechanism is held as one unit on the hand insertion door board.

In the incubator, the bracket is attached and fixed on the holding portion of the hand insertion door board, the latch lever is pivotally supported by the vertical support shaft supported by the bracket, and the latch lever is pivotally biased by the biasing spring to cause the distal end side projection to press the tongue-like portion on the distal end side of the hand insertion door so as to hold the hand insertion door at the closed position. According to this incubator, each latch lever is attached and fixed on the holding portion of the hand insertion door board through the bracket. The distal end side projection of this latch lever presses the tongue portion of the distal end side of the hand insertion door to hold the hand insertion door at the closed position.

In the incubator, the press lever is pivotally supported by the support shaft on the bracket, and when the press lever is pressed, the press lever presses the projecting piece of the latch lever to make the latch lever pivot to the release position. According to this incubator, the press lever is attached by the support shaft common to that of the latch lever on the bracket. That is, the latch lever and the press lever have the same pivot center, and hence the latch lever can be assembled into a compact unit.

According to the incubator comprising the opening mechanism configured to bias the hand insertion door in the opening direction by abutting against the hand insertion door during the pivoting of the hand insertion door in the closing direction before completion of the closing operation, if the operator does not completely close the hand insertion window when closing the window, the hand insertion window opens. This allows the operator to easily recognize that the hand insertion window is not closed, and hence increases the possibility that he/she will perform closing operation for the hand insertion window again. Therefore, the newborn infant container does not easily lose the proper physiological environment for the newborn infant, and the physical condition of the newborn infant is not easily affected.

According to the incubator comprising a braking mechanism configured to brake the pivoting of the hand insertion door on the way in the opening operation during the pivoting of the hand insertion door in the opening direction, the hand insertion window does not abruptly stop at the time of completion of opening operation for the hand insertion window, and hence an impact is not easily generated when the hand insertion window is completely opened. Therefore, a large stress is not imposed on the newborn infant in the newborn infant container at the time of opening the hand insertion window, and the physical condition of the newborn infant is not easily affected.

The above, and other objects, features and advantages of this invention will become readily apparent from the following detailed description thereof which is to be read in connection with the accompanying drawings.

BRIEF DESCRIPTION OF THE DRAWINGS

FIGS. 10A and 10B show one of a pair of left and right hand insertion doors and latch mechanisms of the incubator, in which FIG. 10A is a front view and FIG. 10B is a sectional view taken along a line B-B in FIG. 10A.

DETAILED DESCRIPTION OF THE INVENTION

An incubator according to an embodiment of the present invention will be described below with reference to the accompanying drawings.

(1) Overall Outline

Figure 11:
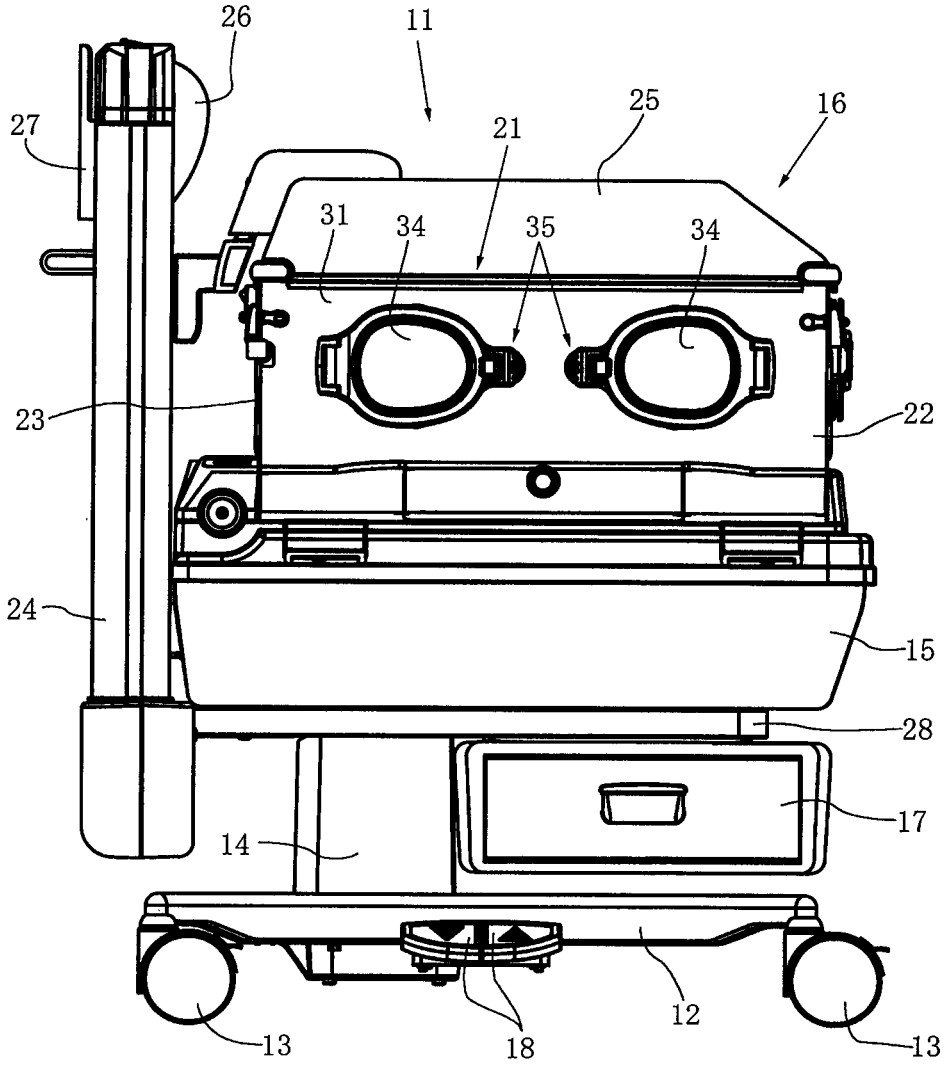
FIG. 11 is a side view showing the overall structure of the incubator.

FIG. 11 shows an incubator according to this embodiment in a closed state. An incubator 11 includes a carriage 12 on which wheels 13 and a strut 14 are mounted. A base portion 15 is supported on the strut 14. The base portion 15 incorporates a control mechanism (not shown) for temperature, humidity, and the like. A newborn infant container 16 is provided on the base portion 15. A drawer 17 for storage is mounted below the base portion 15. The carriage 12 also includes a pedal 18 for adjusting the height of the base portion 15 and the like along the strut 14.

A mattress tray (not shown) is placed in the newborn infant container 16. Side surfaces of the newborn infant container 16 are provided with a pair of lateral treatment doors 21 located on the left and right sides of a newborn infant (not shown) lying on the mattress tray, a leg-side treatment door 22 located on the leg side and a head-side treatment wall 23 located on the head side. A pair of left and right struts 24 is mounted on the carriage 12. Each strut 24 has another strut (not shown) inserted in it in a nested state, which can slide in the strut 24.

Canopies 25 and infrared heaters 26 of the newborn infant container 16 are respectively supported by one and the other of the other left and right struts in the struts 24. The canopies 25 and the infrared heaters 26 can independently move up and down by causing these other struts to slide inside the struts 24. The canopies 25 are also made of a transparent material. Protective tools 27 for preventing the infrared heaters 26 from colliding with a wall surface (not show) of a room are also mounted on the struts 24.

(2) Opening/Closing Operation for Hand Insertion Windows

Figure 10A:
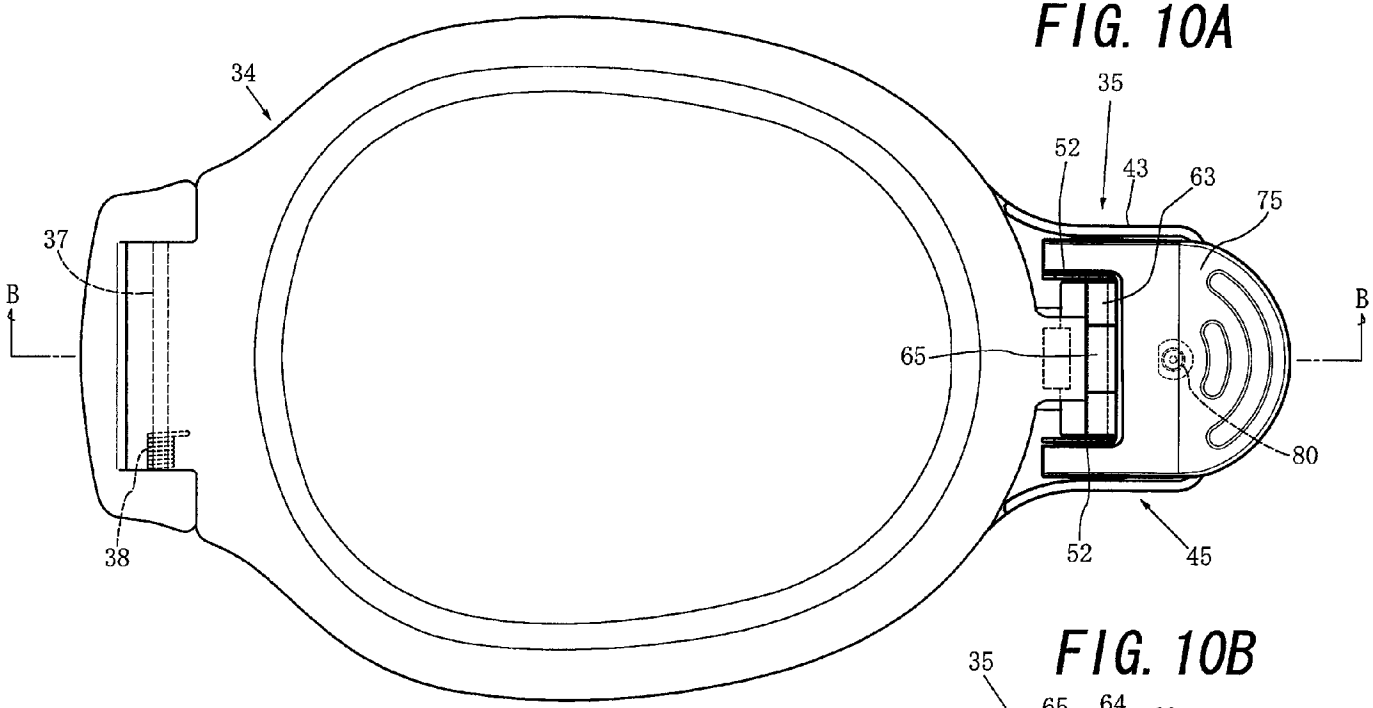
Figure 10B:
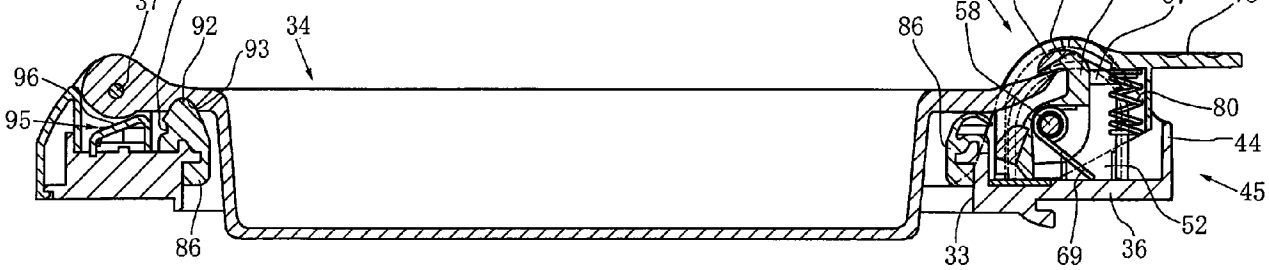

Each lateral treatment door 21 includes transparent outer and inner walls 31 and 32 (FIG. 4) constituting a double-wall structure. The outer and inner walls 31 and 32 include a pair of left and right hand insertion windows 33 (FIG. 4), a pair of left and right hand insertion doors 34 (FIG. 11) which open and close the hand insertion windows 33, and latch mechanisms 35 which hold the hand insertion doors 34 at the closed positions for closing the hand insertion windows 33. FIGS. 10A and 10B show one of the pair of left and right hand insertion doors 34 and one of the pair of left and right latch mechanisms 35.

Figure 1:
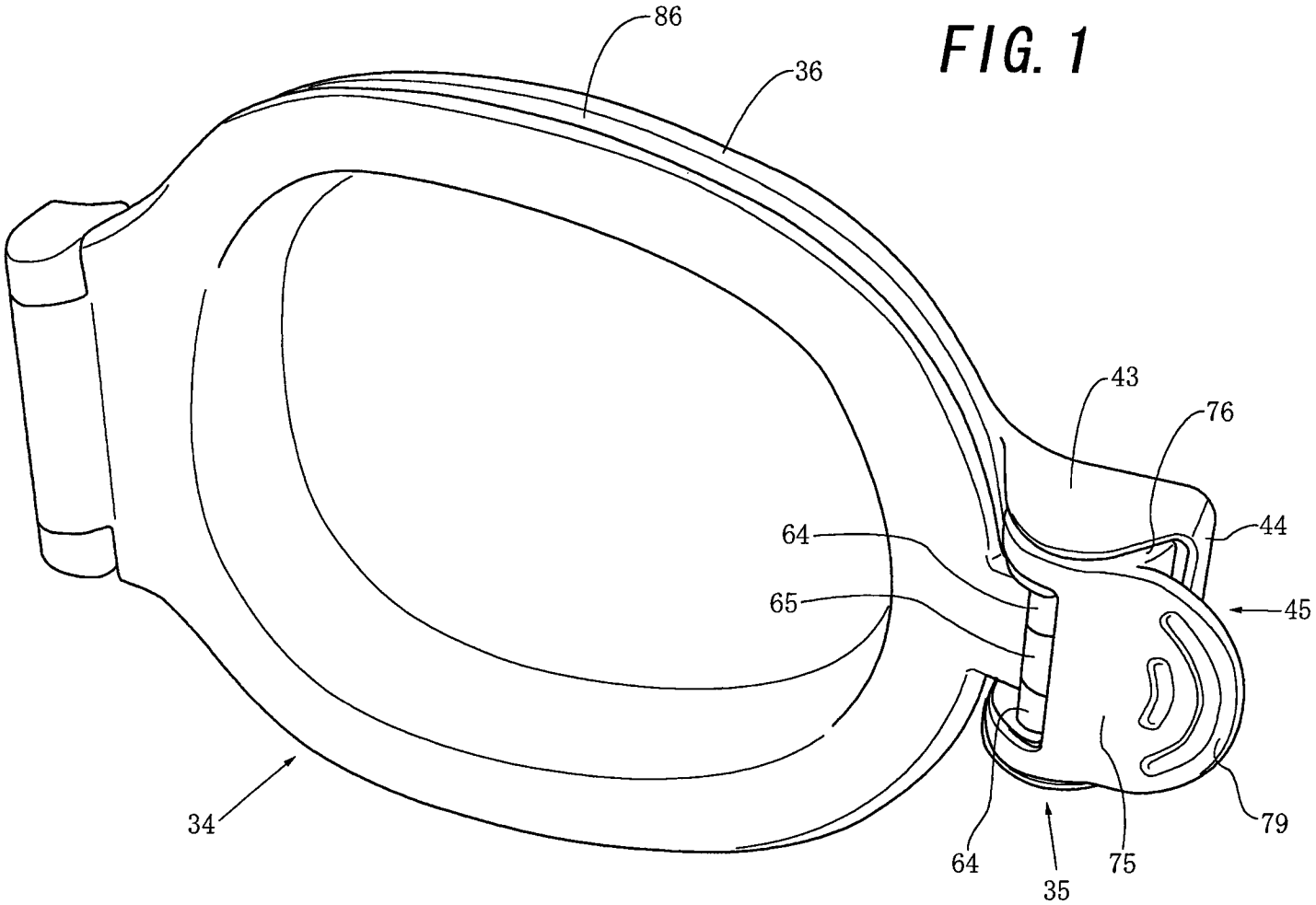
FIG. 1 is an external perspective view showing a hand insertion door and latch mechanism of an incubator according to an embodiment of the present invention.
Figure 4:
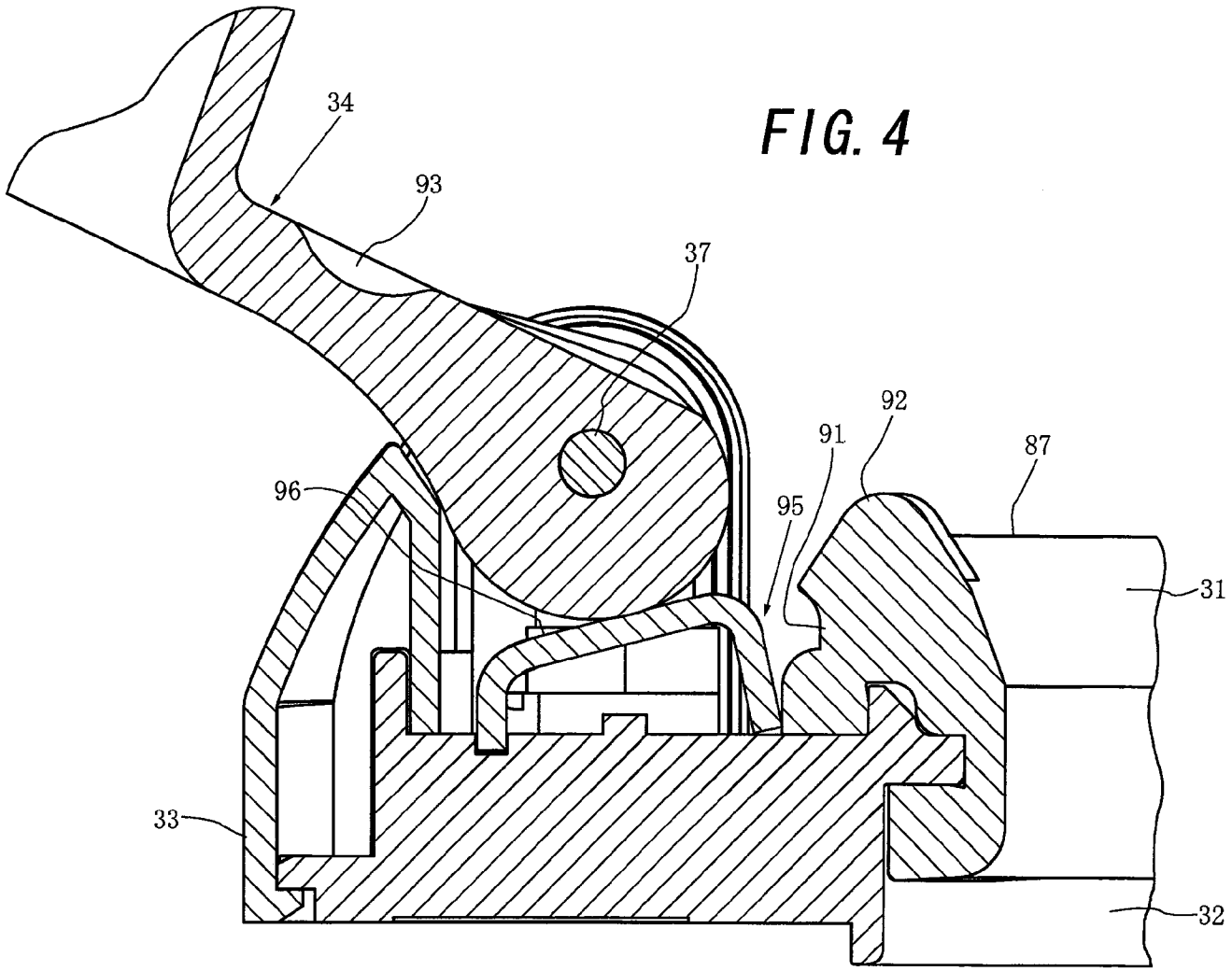
FIG. 4 is a partial sectional view showing the pivot support mechanism of the hand insertion window of the incubator and a state in which the hand insertion door is at the open position.
Figure 9:
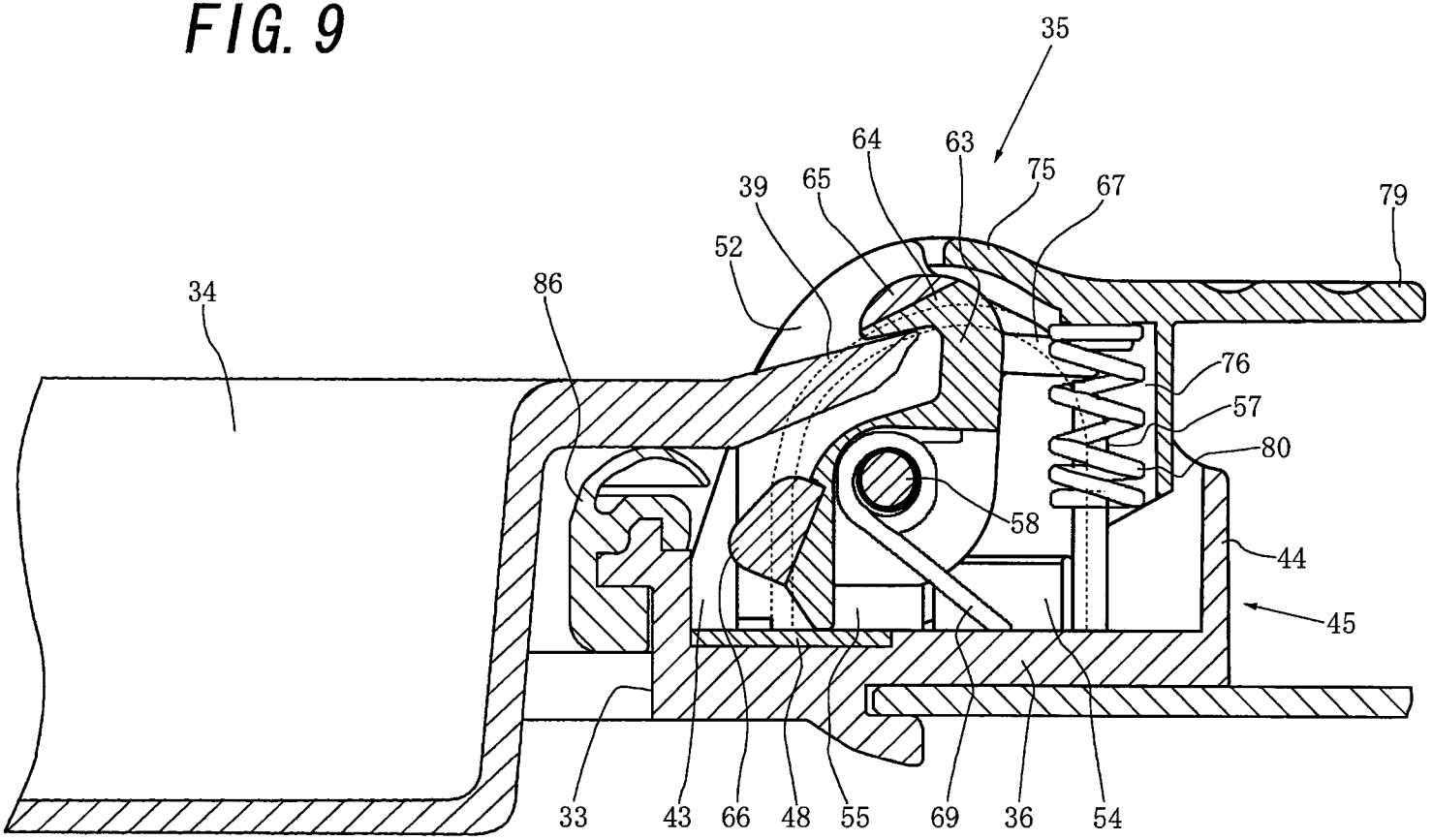
FIG. 9 is a sectional view of the latch mechanism, showing a state in which the hand insertion door is held and locked by the latch lever.

An annular hand insertion door board 36 made of a transparent hard synthetic resin is fitted and screwed to the periphery of the hand insertion window 33 in the outer wall 31 of the newborn infant container 16. As shown in FIG. 1, the hand insertion door 34 is made of a transparent hard synthetic resin and has a saucer-like shape. The hand insertion door 34 is pivotally supported on a portion of the hand insertion door board 36 which is located on the side opposite to the latch mechanism 35 on the diameter. The hand insertion door 34 can pivot about a pivot shaft 37 between the closed position where the hand insertion window 33 is closed as shown in FIGS. 9, 10A and 10B and the open position where the hand insertion window 33 is open as shown in FIG. 4. The hand insertion door 34 is biased by a torsion coil spring 38 fitted on the pivot shaft 37 so as to pivot from the above closed position to the above open position.

Figure 6:
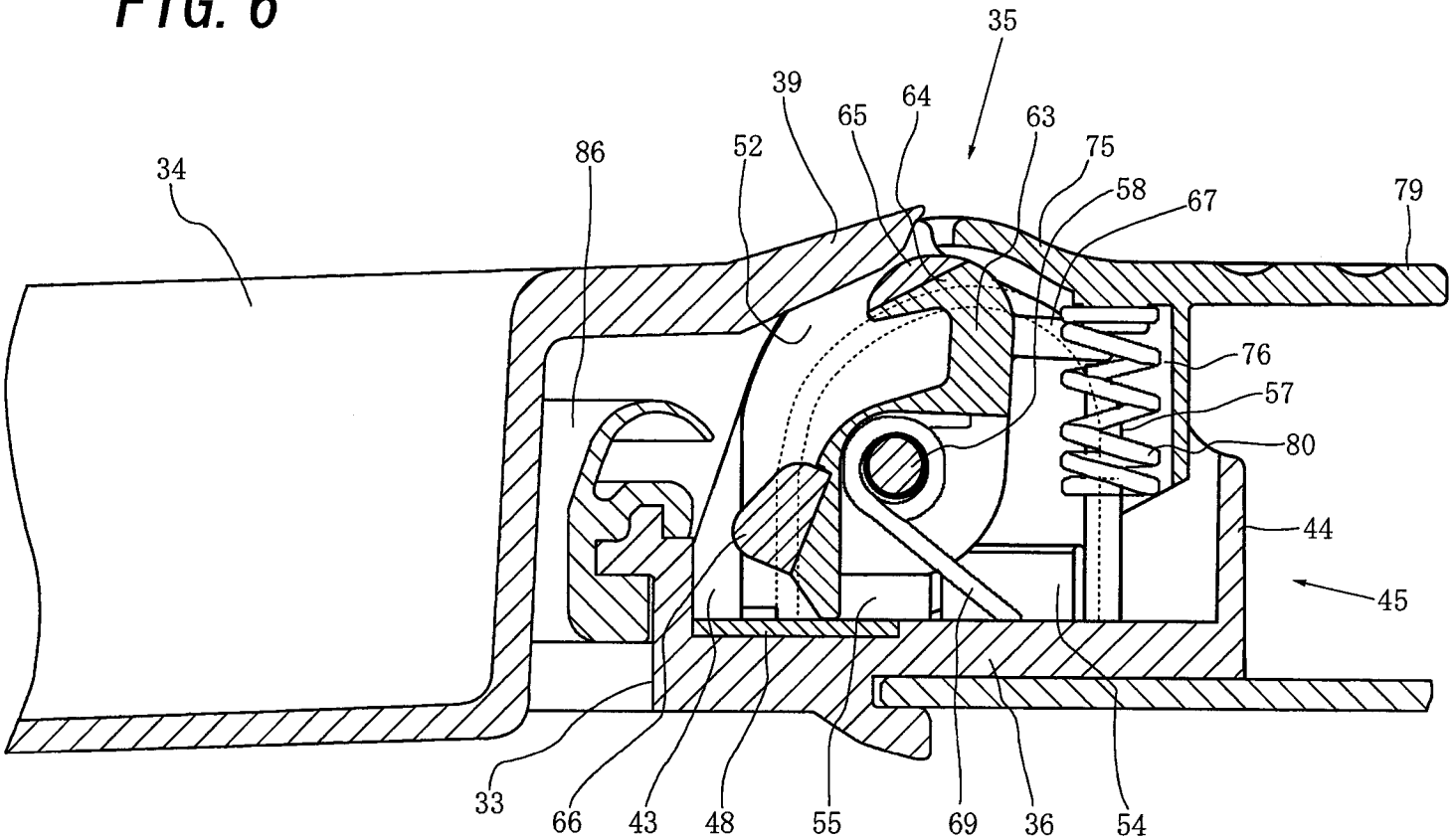
FIG. 6 is a sectional view of the main portion of a latch mechanism of the incubator.
Figure 7:
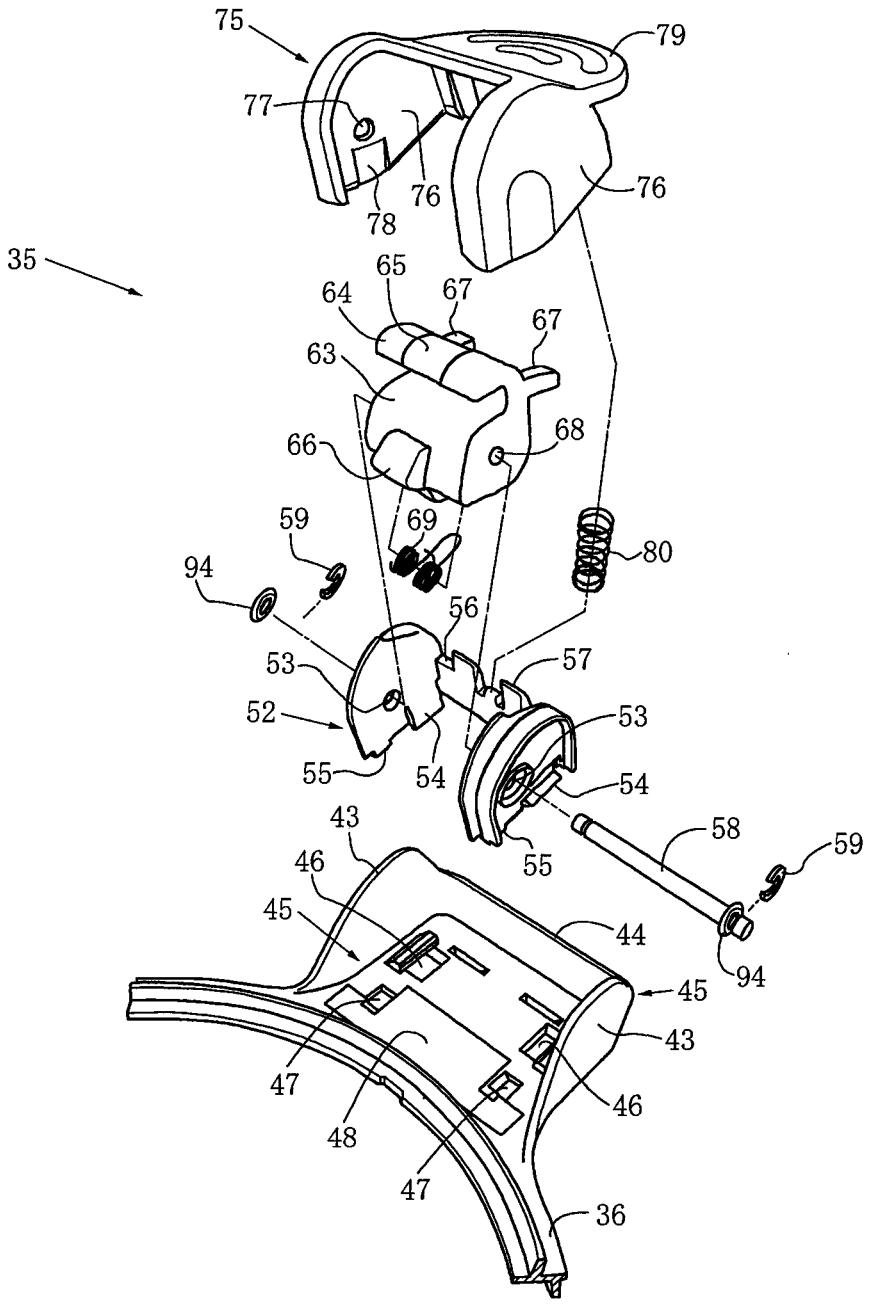
FIG. 7 is an exploded perspective view of the latch mechanism.

FIGS. 6 to 10B show the latch mechanism of the hand insertion door 34 described above. As shown in FIG. 7, in particular, the latch mechanism is attached and held at a side portion of the hand insertion door board 36 at the position opposite to the pivot support mechanism of the hand insertion door 34. That is, a holding portion 45 is provided at one side portion of the hand insertion door board 36. The holding portion 45 includes a pair of side wall portions 43 facing each other and a back surface side wall portion 44 coupling the side wall portions 43. The holding portion 45 is formed in a U shape.

A pair of locking holes 46 is formed in the bottom portion of the holding portion 45. A pair of positioning concave portions 47 is formed near the locking holes 46. An elastic sheet 48 is bonded at a position on the front side of the positioning concave portions 47.

A bracket 52 is attached by the holding portion 45 of the hand insertion door board 36. The bracket 52 includes bearing holes 53 in its two side portions and a pair of locking pawls 54 on the lower surfaces. The locking pawls 54 are locked in the locking holes 46 of the holding portion 45. Positioning projections 55 are formed on the bracket 52 at positions before the locking pawls 54. The positioning projections 55 are fitted in the positioning concave portions 47.

The bracket 52 has two side portions, each having the bearing hole 53, which are coupled to each other through a coupling plate 56. Stoppers 57 protrude upward from the coupling plate 56. A support shaft 58 extends through the bearing holes 53. The support shaft 58 serves as a pivot support means for a latch lever 63 and a press lever 75. A clip 59 restricts the movement of the support shaft 58 in the axial direction.

The latch lever 63 includes a distal end side projection 64 on the upper end side. An elastic member 65 is provided at the middle position of the distal end side projection 64 in the lateral direction. A projection 66 is formed on a proximal end portion of the latch lever 63. Projecting pieces 67 protrude from the rear surface side of the latch lever 63. The projecting pieces 67 are pressed by the press lever 75. A shaft through hole 68 is formed in the latch lever 63. The support shaft 58 extends through the shaft through hole 68 to make the bracket 52 pivotally support the latch lever 63. A torsion coil spring 69 is attached around the support shaft 58 in a lower concave portion of the latch lever 63. With the torsion coil spring 69, the distal end side projection 64 of the latch lever 63 is biased to press a tongue-like portion 39 on the distal end side of the hand insertion door 34 in the counterclockwise direction in FIG. 6.

The press lever 75 is mounted to cover the latch lever 63. Circular concave portions 77 are formed in both side wall portions 76 of the press lever 75. The concave portions 77 receive the two ends of the support shaft 58. Inclined grooves 78 are formed to guide the support shaft 58 to the concave portions 77. The press lever 75 includes a pressed portion 79 on the rear surface side. Pressing the pressed portion 79 will make the press lever 75 pivot about the support shaft 58 in the clockwise direction in FIG. 6. A compression coil spring 80 is inserted between the lower surface of the press lever 75 and the bracket 52 so as to react against the pivoting movement of the press lever 75 in the clockwise direction. The compression coil spring 80 biases the press lever 75 to pivot in the counterclockwise direction. Note that the maximum pivot amount of the press lever 75 in the counterclockwise direction corresponds to the position where the distal end side lower portion of the press lever 75 abuts against the elastic sheet 48 (FIG. 6).

In order to shift the state in which the hand insertion door 34 opens the hand insertion window 33 as shown in FIG. 4 to the state in which the hand insertion door 34 closes the hand insertion window 33 as shown in FIGS. 9, 10A and 10B, the operator makes the hand insertion door 34 pivot against the biasing force of the torsion coil spring 38 shown in FIG. 10A to cause the tongue-like portion 39 as the pivot distal end portion of the hand insertion door 34 to press the distal end side projection 64 of the latch lever 63 at the hold position, as shown in FIG. 6. Pressing with the tongue-like portion 39 will make the latch lever 63 pivot about the support shaft 58 to the release position against the biasing force of the torsion coil spring 69.

Figure 2:
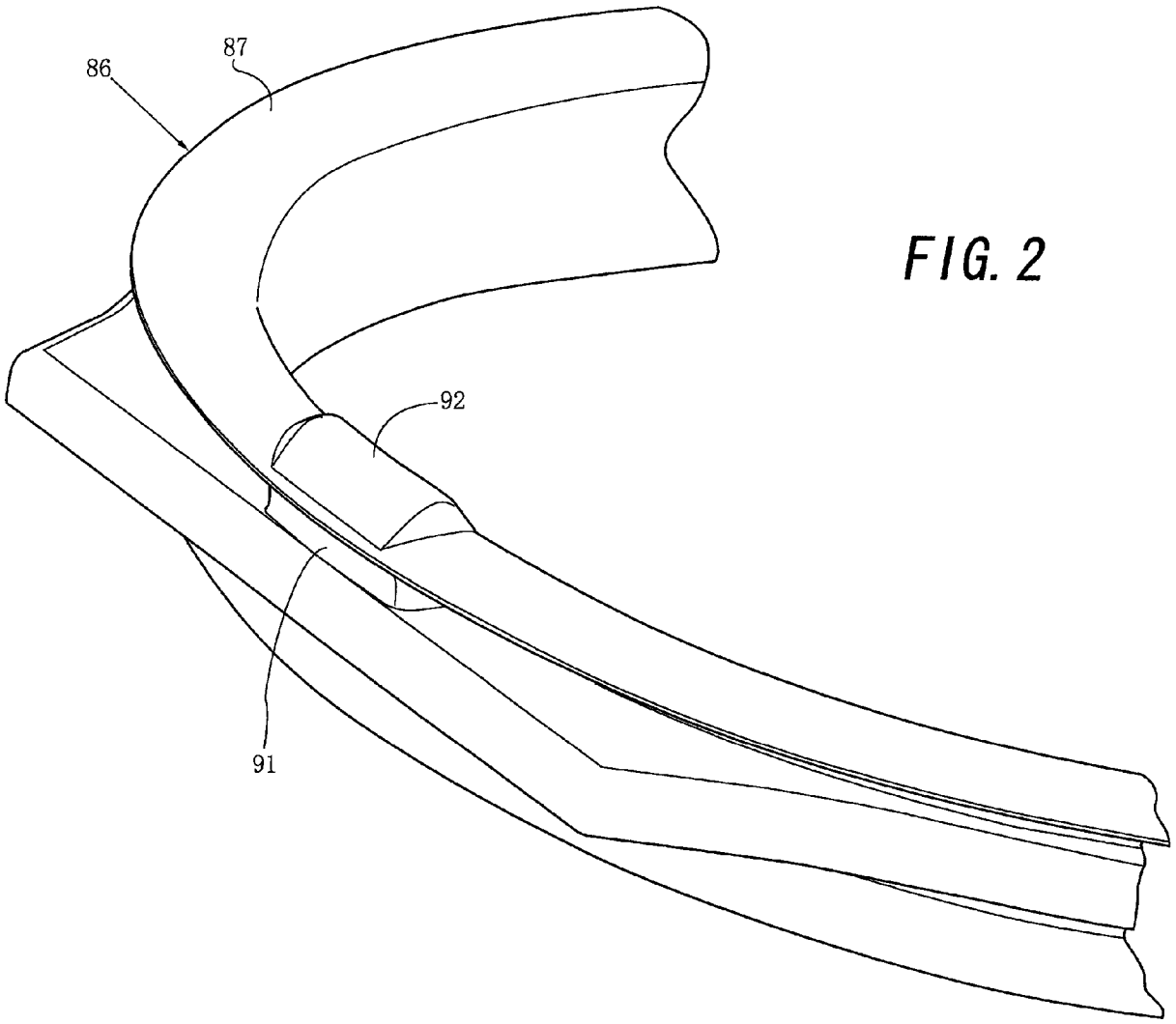
FIG. 2 is a perspective view of the packing portion of the hand insertion window of the incubator.

When the operator makes the hand insertion door 34 further pivot from the release position, the tongue-like portion 39 of the hand insertion door 34 moves closer to the support shaft 58 than the distal end side projection 64 of the latch lever 63, and the latch lever 63 pivots to the hold position owing to the biasing force of the torsion coil spring 69, as shown in FIGS. 9, 10A and 10B. As a consequence, the hand insertion door 34 is held at the closed position by the latch lever 63 to close the hand insertion window 33. Note that when the operator makes the hand insertion door 34 greatly pivot in the closing direction, a packing portion 86 in FIG. 2 is compressed, and the tongue-like portion 39 of the hand insertion door 34 abuts against the projection 66 of the latch lever 63. That is, the projection 66 forms a stopper.

In contrast, in order to shift the state in which the hand insertion door 34 closes the hand insertion window 33 as shown in FIGS. 9, 10A and 10B to the state in which the hand insertion door 34 opens the hand insertion window 33 as shown in FIG. 4, the operator presses the rear surface side lower surface of the press lever 75 in the lateral direction relative to the outer wall 31 of the newborn infant container 16 against the biasing force of the compression coil spring 80. That is, the operator presses the pressed portion 79 of the press lever 75 in the lateral direction toward the outer wall 31 of the newborn infant container in a direction perpendicular to the outer wall 31. When the operator presses the pressed portion 79 of the press lever 75 downward, the press lever 75 pivots about the support shaft 58 in the clockwise direction shown in FIG. 8. Since the lower surface of the press lever 75 presses the projecting pieces 67 of the latch lever 63 downward, the distal end side projection 64 of the latch lever 63 shifts downward from the tongue-like portion 39 of the hand insertion door 34, as shown in FIG. 8.

Figure 8:
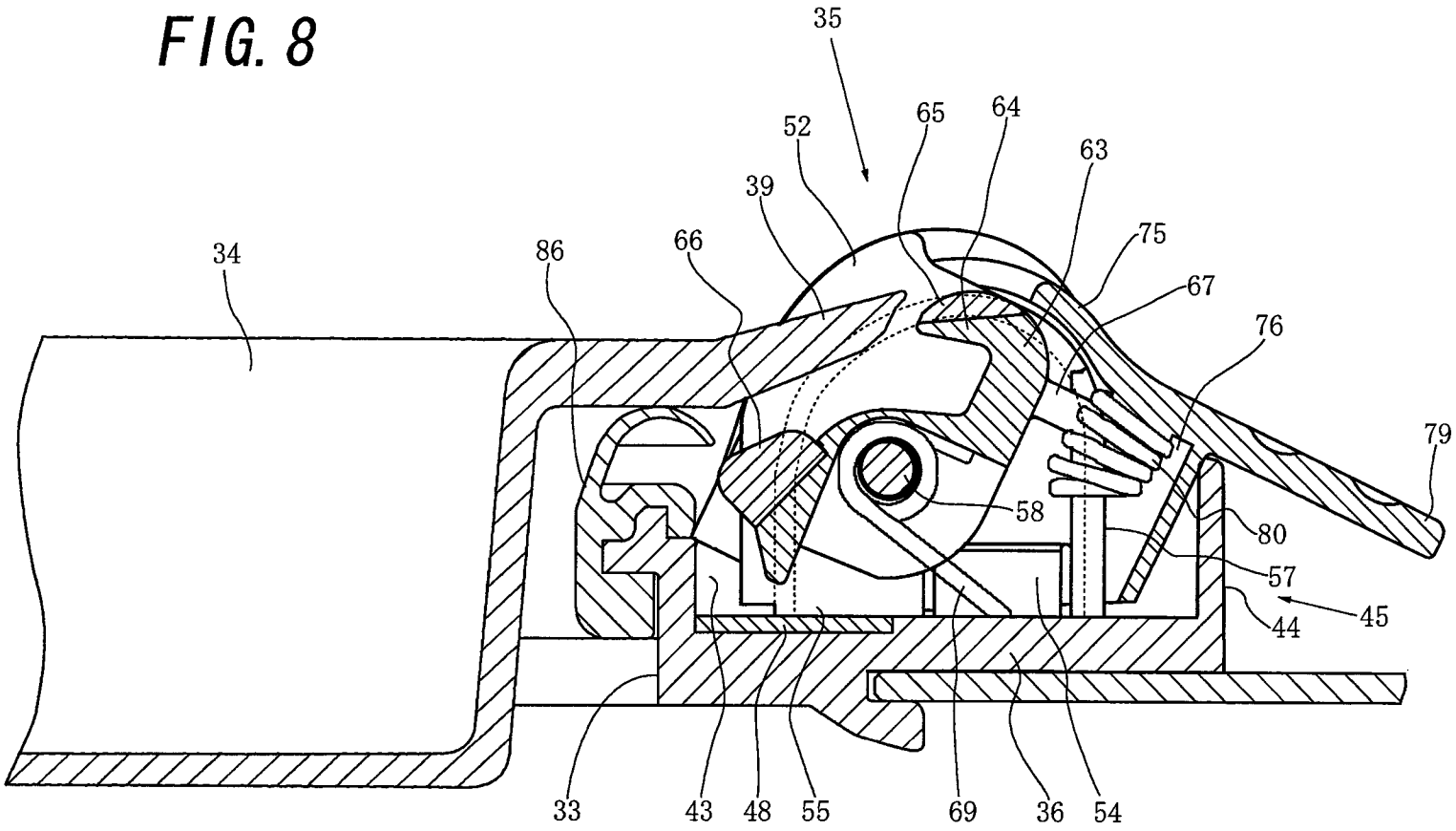
FIG. 8 is a sectional view of the latch mechanism, showing a state in which the latch lever pivots to the release position.

When the operator makes the press lever 75 pivot about the support shaft 58 in the clockwise direction in this manner, as shown in FIG. 8, the press lever 75 makes the latch lever 63 pivot, through the projecting pieces 67, to the release position. This unlatches the tongue-like portion 39 of the hand insertion door 34 from the latch lever 63. The biasing force of the torsion coil spring 38 makes the hand insertion door 34 pivot. The hand insertion door 34 then opens the hand insertion window 33, as shown in FIG. 4. When releasing the pressure of the press lever 75, the biasing force of the compression coil spring 80 makes the press lever 75 pivot about the support shaft 58 in the counterclockwise direction. Making the press lever 75 pivot forward and backward in this manner will release the pressure from the latch lever 63. As a result, the torsion coil spring 69 returns the latch lever 63 from the release position to the hold position.

The latch mechanisms 35 shown in FIGS. 6 and 7 has a symmetrical structure on the two end sides in the longitudinal direction of the support shaft 58. Therefore, when the hand insertion doors 34 which close the pair of left and right hand insertion windows 33 shown in FIG. 11 are symmetrically arranged on a side surface in the back and forth direction, the hand insertion doors 34 can use the common latch mechanisms 35. That is, only attaching latch mechanisms having the same structure upside down to each other can commonize the latch mechanisms of the left and right hand insertion doors 34 instead of preparing the latch mechanisms 35 of the left hand insertion door 34 and the latch mechanisms 35 of the right hand insertion door 34 as mechanisms having different structures. This can reduce the number of types of each latch mechanism and commonize the number of components, thereby achieving a reduction in cost.

(3) Recognition of Unclosed State of Hand Insertion Window

Figure 3:
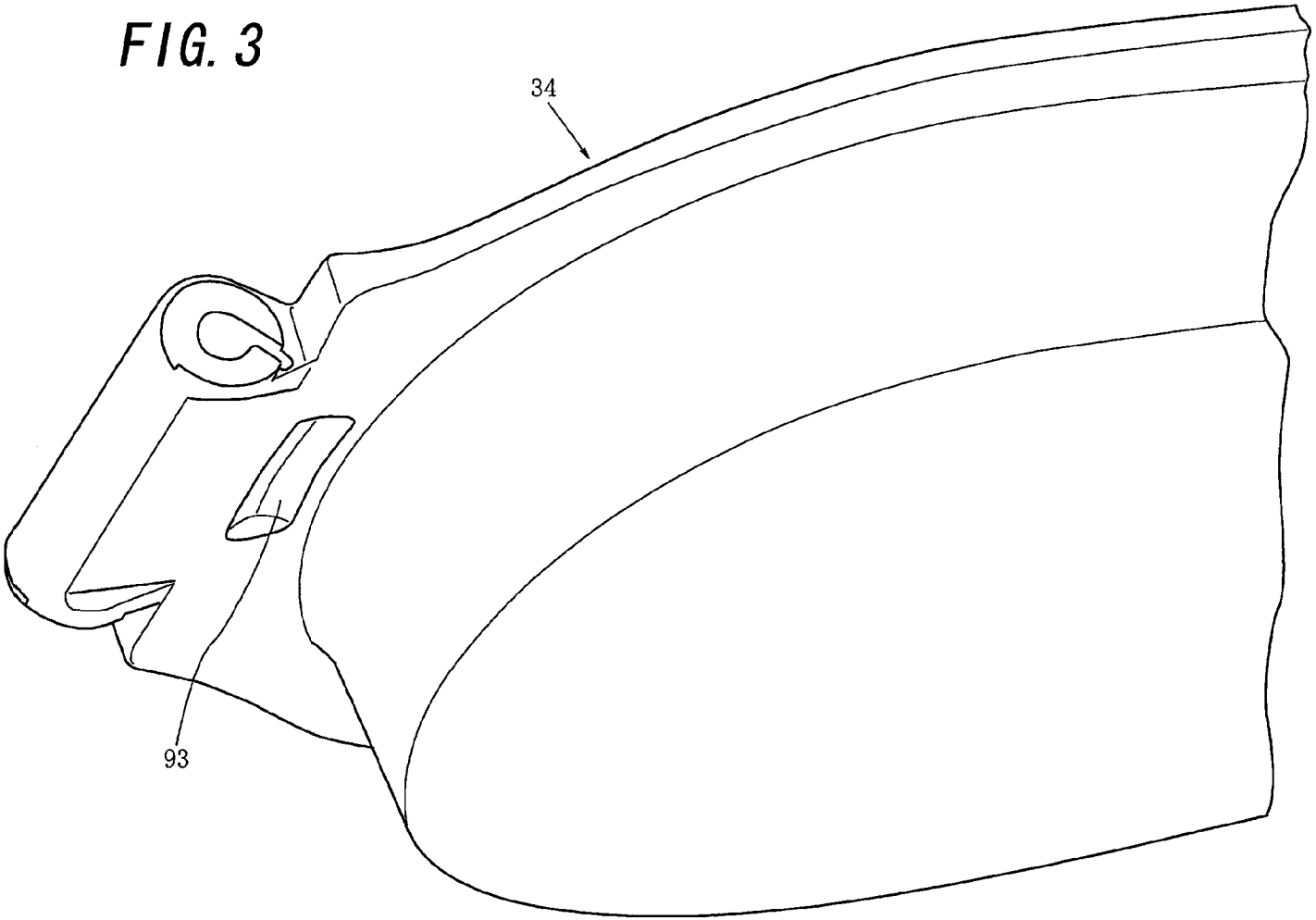
FIG. 3 is a partial perspective view seen from the inside of the hand insertion door of the incubator.

As shown in FIG. 10B, the annular packing member 86 made of silicone rubber is fitted in the inner rim of the hand insertion door board 36. As shown in FIG. 2, most of the portion of the packing member 86 which abuts against the hand insertion door 34 where the hand insertion window 33 is in the closed state is a fin-like portion 87. On the contrary a portion of the packing member 86 which is near the pivot shaft 37 of the hand insertion door 34 is a thick portion 91. In addition, a convex portion 92 for preventing the wrong attachment of the packing member 86 is provided on the thick portion 91. Furthermore, as shown in FIG. 3, a concave portion 93 in which the convex portion 92 is fitted is provided in a portion of the hand insertion door 34 which is near the pivot shaft 37.

As the operator makes the hand insertion door 34 pivot from the state in which the hand insertion door 34 opens the hand insertion window 33 to the state in which the hand insertion door 34 closes the hand insertion window 33, the hand insertion door 34 abuts against the packing member 86 before the hand insertion door 34 closes the hand insertion window 33. When the operator makes the hand insertion door 34 further pivot, the hand insertion door 34 presses the packing member 86 to elastically deform it before the latch lever 63 holds the hand insertion door 34. This elastic deformation ensures the airtight state achieved by the packing member 86 and generates elastic rebound force in particularly the thick portion 91 and the convex portion 92. This elastic rebound force biases the hand insertion door 34 in the direction to open the hand insertion window 33.

With this structure, if the operator erroneously recognizes that the hand insertion door 34 closes the hand insertion window 33, in spite of the fact that the hand insertion door 34 has not completely closed the hand insertion window 33, or the hand insertion door 34 has not completely closed the hand insertion window 33 for some reason, the hand insertion door 34 pivots in the direction to open the hand insertion window 33. This allows the operator to easily recognize that the hand insertion window 33 is not closed, and hence increases the possibility that the operator will perform closing operation for the hand insertion window 33 again. Note that the torsion coil spring 38 also biases the hand insertion door 34 from the closed position to the open position. If this biasing force is strong, the hand insertion door 34 abruptly pivots. For this reason, the biasing force of the torsion coil spring 38 is not very strong.

(4) Quieting of Opening/Closing Operation for Hand Insertion Window

Figure 5:
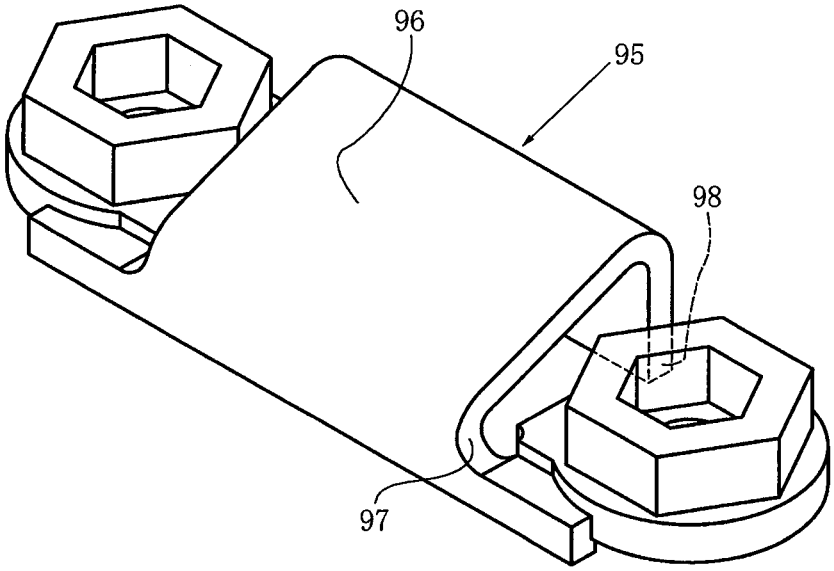
FIG. 5 is a perspective view of a braking mechanism of the incubator.

The elastic member 65 made of silicone rubber or the like is attached to the distal end side projection 64 of the latch lever 63. In addition, as shown in FIG. 7, a spacer 94 is fitted on the support shaft 58 between the latch lever 63 and the bracket 52 to brake the pivoting movement of the latch lever 63 caused by the biasing force of the torsion coil spring 69. Further as shown in FIGS. 4 and 5, a braking mechanism 95 made of a synthetic resin is attached to the hand insertion door board 36. A low-level side end portion 97 of an inclined surface 96 is integral with other portions of the inclined surface 96, whereas a high-level side end portion 98 of the inclined surface 96 is a free end.

In addition, as shown in FIG. 5, a portion of the hand insertion door 34 around the pivot shaft 37, which is located near the braking mechanism 95 does not have a true circular section but has a sectional radius such that when the hand insertion door 34 closes the hand insertion window 33, the portion is spaced apart from the inclined surface 96 of the braking mechanism 95, whereas as the hand insertion door 34 opens the hand insertion window 33, the portion approaches the inclined surface 96 and comes into contact with the inclined surface 96 on the way to press the inclined surface 96. When the inclined surface 96 is pressed, the braking mechanism 95 elastically deforms such that the high-level side end portion 98 moves away from the low-level side end portion 97, and the height of the inclined surface 96 decreases, thereby absorbing the pressing force.

As the operator makes the hand insertion door 34 pivot from the state in which the hand insertion window 33 is open as shown in FIG. 4 to the state in which the hand insertion window 33 is closed, as shown in FIG. 6, the tongue-like portion 39 of the hand insertion door 34 abuts against the distal end side projection 64 of the latch lever 63 first, as shown in FIG. 6. Since the middle portion of the distal end side projection 64 is formed from the elastic member 65 made of silicone rubber, even if the tongue-like portion 39 roughly abuts against the distal end side projection 64, an impact is not easily generated. When the operator makes the hand insertion door 34 further pivot from the state in FIG. 6, the elastic member 65 of the distal end side projection 64 is pressed to make the latch lever 63 pivot to the release position. When the hand insertion door 34 further pivots, the tongue-like portion 39 moves inside the latch lever 63, as shown in FIG. 9

When the tongue-like portion 39 moves inside the latch lever 63 and does not press the distal end side projection 64, the latch lever 63 pivots from the release position to the hold position owing to the biasing force of the torsion coil spring 69 to hold the tongue-like portion 39. However, since the spacer 94 brakes the pivoting movement of the latch lever 63 caused by the biasing force of the torsion coil spring 69, the latch lever 63 does not pivot abruptly, thereby making it difficult to generate an impact at the time of completion of the pivoting movement.

In contrast, when the operator manipulates the press lever 75 to release the tongue-like portion 39 of the hand insertion door 34 from the latch lever 63, the biasing force generated by the elastic rebound force of the packing member 86, in particular of the thick portion 91 and the convex portion 92, and the biasing force of the torsion coil spring 38 make the hand insertion door 34 pivot from the state in which the hand insertion window 33 is closed as shown in FIGS. 9, 10A and 10B to the state in which the hand insertion window 33 is open as shown in FIG. 4 through the state shown in FIG. 8. However, since the braking mechanism 95 shown in FIG. 5 brakes the pivoting movement of the hand insertion door 34 on the way to the open state, an impact is not easily generated at the time of completion of the pivoting movement.

Having described a specific preferred embodiment of this invention with reference to the accompanying drawings, it is to be understood that the invention is not limited to the precise embodiment, and that various changes and modifications may be effected therein by one skilled in the art without departing from the scope or spirit of the invention as defined in the appended claims.

For example, in the above embodiment, the elastic member 65 made of silicone rubber is attached to the distal end side projection 64 of the latch lever 63. However, the elastic member 65 of the distal end side projection 64 may be formed from a material other than silicon rubber as long as it can absorb impacts. Although the packing member 86 is also formed from silicone rubber, it may be formed from a material other than silicone rubber as long as it provides elastic rebound force. Furthermore, in the above embodiment, the present invention is applied to the switching type incubator. However, the present invention can also be applied to a closed type incubator.

The invention claimed is:

1. An incubator comprising:

a hand insertion window provided on a side surface of a newborn infant container;

a hand insertion door configured to pivot to open and close said hand insertion window; and a latch mechanism configured to hold said hand insertion door at a closed position for the closing of said hand insertion window;

a hand insertion door board attached along a peripheral portion of said hand insertion window, wherein said hand insertion door board is provided with a first lateral side portion located at one lateral end portion of said hand insertion door board and a second lateral side portion located at the other lateral end portion of said hand insertion door board;

a pivot shaft provided on the first lateral side portion of said hand insertion door board, wherein said hand insertion door is supported so as to be pivotal about a vertical axis of said pivot shaft;

a bracket attached and fixed on a holding portion of said hand insertion door board; said latch mechanism comprising a latch lever configured to pivot between a hold position for the holding of said hand insertion door and a release position for releasing the holding of said hand insertion door on the side surface of the newborn infant container and a press lever configured to pivot about an axis identical or parallel to a pivot axis of said latch lever to make said latch lever pivot to the release position, wherein said press lever and said latch lever are separate units, wherein said latch lever is separate from and pivotable within said press lever, wherein said latch mechanism is provided on the second lateral side portion of said hand insertion door board, wherein said latch mechanism holds said hand insertion door at a closed position by pressing a tongue-like portion on a distal end side of said hand insertion door, wherein said latch lever is pivotally supported by a vertical support shaft supported by said bracket, wherein said latch lever is pivotally biased by a biasing spring to cause a distal end side projection to press the tongue-like portion on the distal end side of said hand insertion door so as to hold said hand insertion door at the closed position;

said press lever is pivotally supported by said support shaft on said bracket; and when said press lever is pressed, said press lever presses a projecting piece of said latch lever to make said latch lever pivot to the release position.

2. An incubator according to claim 1, further comprising:

an opening mechanism configured to bias said hand insertion door in an opening direction by abutting against the hand insertion door during pivoting of said hand insertion door in a closing direction before completion of a closing operation.

3. An incubator according to claim 1, further comprising:

a braking mechanism configured to brake the pivoting of said hand insertion door for at least a portion of an opening operation during the pivoting of said hand insertion door in an opening direction.

* * * * *